United States Patent [19]

Okoh et al.

[11] Patent Number: 4,531,893

[45] Date of Patent: Jul. 30, 1985

[54] VARIABLE OUTPUT VANE PUMP

[75] Inventors: Tomio Okoh, Toyamaken; Tomoaki Matsumoto; Noboru Hirokawa, both of Toyama, all of Japan

[73] Assignee: Kabushiki Kaisha Fujikoshi, Toyama, Japan

[21] Appl. No.: 532,834

[22] Filed: Sep. 16, 1983

[30] Foreign Application Priority Data

Sep. 28, 1982 [JP] Japan ..... 57-167618

[51] Int. Cl.[3] ..... F04B 49/00

[52] U.S. Cl. ..... 417/220; 418/26; 418/27; 418/30

[58] Field of Search ..... 418/30, 24–27; 417/220, 218, 310

[56] References Cited

U.S. PATENT DOCUMENTS

| | | | |
|---|---|---|---|
| 2,635,551 | 4/1953 | DeLancey | 417/220 |
| 2,768,585 | 10/1956 | Hardy | 417/220 X |
| 3,656,869 | 4/1972 | Leonard . | |
| 3,743,445 | 7/1973 | Dworak et al. | 418/30 X |
| 4,342,545 | 8/1982 | Schuster . | |
| 4,405,288 | 9/1983 | Stockton | 417/220 |
| 4,437,819 | 3/1984 | Merz | 418/30 |

*Primary Examiner*—Edward K. Look

*Attorney, Agent, or Firm*—Spencer & Frank

[57] ABSTRACT

A variable output vane pump for use with an automotive automatic transmission. At least one pressure chamber is formed between the circular bore of a housing and the outer circumference of a ring by means of at least one seal pin which is fitted in the axial groove formed in the ring circumference and which is opened in the housing bore. The ring is urged by the action of a spring, which is fitted in the housing, in a direction opposite to the pressure to be built up by the pressure chamber. An elastic member is fitted in the bottom of the axial groove to urge the seal pin both toward the housing bore and at the same time toward one of the side walls of the axial groove. The urging direction of the elastic member and a tangential line, on which the seal pin is tangential to the housing bore, are angularly positioned at an acute angle with respect to each other.

13 Claims, 21 Drawing Figures

VARIABLE OUTPUT VANE PUMP

BACKGROUND OF THE INVENTION

1. Field of the Invention

The present invention relates to a variable output vane pump and, more particularly, to a variable output vane pump which is suitable for use with an automotive automatic transmission.

2. Description of the Prior Art

A hydraulic pump for an automatic transmission according to the prior art generally uses an inner or outer gearing of the constant output type. Since, in this case, an output proportional to the r.p.m. of the engine can be attained, it becomes more than necessary for a high r.p.m. so that most of it is returned from a flow regulator to an oil tank. The energy loss at this portion raises a problem. In order to solve this problem, it is necessary to make the pump of the variable output type so that the theoretical output of the pump itself may be reduced for an r.p.m. higher than a predetermined value.

The variable output pump thus far described is exemplified by a variable displacement pump, for example, which is disclosed in U.S. Pat. No. 4,342,545. This pump is an improvement over the prior art, but a displacement control chamber is formed between a ring and the inner wall of a housing so that seal portions are formed at two positions, i.e., between the ring and a pivot pin providing a pivot for the ring and between the ring and the pump housing. The sealing performance of the vane pump is so influenced by an error in the shape of the circular bore of the housing and by an error in the shape of the outer circumference of the ring that it can be maintained at a satisfactory level in some cases but with the sliding resistance being increased to raise a difficulty in the responsiveness to the output. In other cases, on the other hand, the responsiveness to the output is improved but with the sealing performance being degraded, thus raising an inconsistency. This inconsistency is followed by a disadvantage that the housing and the ring have to be machined with high accuracy.

There arises another disadvantage in that difficulty is encountered during machining because of the structure in which one half of the pivot pins for rocking the ring are fitted in the inner wall of the pump housing whereas the other half are fitted in semi-cylindrical grooves which are formed at the ring side. Moreover, since the suction and discharge of the pump are conducted in the axial direction through arcuate ports formed in the pump housing, there arises a defect in that the total length of the pump is enlarged in the axial direction. (In the case of a front-engine and front-drive automobile, it is necessary to make the axial length of the pump as small as possible.) On the other hand, the suction and discharge part arrangement is the so-called "one-side suction" which raises a problem in producing suction for a fast run. As to the sealing at the side opposite to the pivot of the ring, moreover, the center of the arc of the sealing face of the housing is offset from the center of rotation of the sealing portion, i.e., the center of the pivot. As a result, the spacing between the sealing portion of the ring and the sealing face of the housing is varied by the rocking motions of the ring which makes it difficult to ensure reliable sealing performance and durability so that the sliding resistance at the sealing portion is varied which raises the concern that the smooth sliding motions of the ring could be obstructed. Still moreover, the hydraulic force $F_R$, which is generated in the ring by the pumping action exerted upon the ring, is applied as it is in the pivotting direction so that the contact load at the pivot portion becomes high thereby increasing the sliding resistance. There arises another problem that any excessive force $F_R$ blocks the smooth rocking motions of the ring.

According to the disclosure of U.S. Pat. No. 3,656,869, two separate opposed pressure chambers are formed between a cam ring and the bore of a housing by means of a sealing pin. Moreover, fluid circuitry including an automatic pressure regulator valve is in fluid communication with each of the pressure zones so that the pressure balance or ratio of pressures across the cam ring may be controlled. The structure thus disclosed succeeds in improving the problems of the sealing structure of the prior art described above. However, the seal pin is merely fitted loosely in the transverse openings of the outer circumference of the cam ring and may fail to ensure a complete sealing effect. Moreover, when the cam ring is controlled by the differential pressure between the two opposed chambers, there arises a concern that the maximum eccentricity of the cam ring cannot alway be held at the start of the pump so that the pump may not operate as expected.

SUMMARY OF THE INVENTION

It is therefore an object of the present invention to provide a pump from which the defects of the prior art thus far described are eliminated and which is enabled to have its sealing performance improved to provide high durability and performance.

Another object of the present invention is to provide a variable output vane pump which has such an elastic member that provides complete elastic restoration having a large deflection and high strength even within a limited space so as to can sufficiently satisfy the required function.

A further object of the present invention is to provide a variable output vane pump which has smooth ring motions so that it can provide a high output responsiveness to changes in its r.p.m. to ensure the necessary output in response to the minimum input.

Still further object of the present invention is to provide a variable output vane pump which can have a small axial length and provide suction from the two sides of a rotor so that it finds a suitable application as a hydraulic pump for an automotive automatic transmission.

Yet another object of the present invention is to provide a variable output vane pump which has its parts reduced in number and its piping simplified.

Still another object of the present invention is to provide a variable output vane pump which can be used in an automatic transmission, while replacing a constant output pump of the prior art, without any drastic change in the hydraulic system of the conventional automatic transmission.

The several objects thus far described and the other objects to be described hereinafter can be achieved by a variable output vane pump comprising: a pump housing; a rotor supported rotatably within said housing; a plurality of vanes fitted in the outer circumference of said rotor in such a manner that they can be displaced radially into and out of said rotor; a ring supported pivotally by a pivot portion, which provides a connection between the circular bore of said housing and the outer circumference of said ring, and encloses said rotor and said vanes; and inlet and outlet ports formed in said housing, at least one pressure chamber for pivotting said ring being formed between the circular bore of said housing and the outer circumference of said ring by means of at least one seal pin which is fitted in an axial groove formed in the outer circumference of said ring and opened in said circular bore of said housing, said ring being urged by the action of a spring, which is fitted in said housing, in a direction opposite to that of the pressure, which is built up by said pressure chamber, namely, in a direction such that the axis of said ring leaves the axis of rotation of said rotor, wherein the improvement resides in that an elestic member is fitted in the bottom of the axial groove, which is formed in the outer circumference of said ring and opened in the circular bore of said housing, thereby to urge said seal pin both toward the circular bore of said housing and at the same time toward one of the side walls of the axial groove; and in that the urging direction of said elastic member and a tangential line, on which said seal pin is tangential to the circular bore of said housing, are angularly positioned at an acute angle with respect to each other. According to the construction thus far described, the pressure chamber ensure reliable seals despite the low sliding resistances of the seals, because their one or two ends are sealed dynamically by means of the seal pin, so that the sealing performance is improved to provide a high-performance pump which has a high durability and a low input power loss. At the start of the pump, moreover, the cam ring can always be held at the maximum eccentric position by the action of the spring.

According to a preferred embodiment, each of said elastic members may preferably be made of a formed wire spring which is contoured to resemble the outer periphery of the bottom of each of said grooves and which has its inner end portion bent inward to have such a height as not to be folded.

According to this construction, the formed wire spring is so devised that its contact height may become equal to the diameter thereof when it is depressed and that its total length may be elongated as much as possible. As a result, the formed wire spring does not require any large space in the radial direction of the ring but can reduce the size of the ring so that it can enjoy not only a large free length and a small contact height but also a complete elastic restoration having a sufficient deflection and a high strength even within the groove having a limited space. As a result, the seal pin can always be urged properly within the circular bore of the housing irrespective of the values of the relative displacements of the ring and the housing bore thereby to complete the sealing function.

According to another aspect of this invention, there are two pressure chambers: a first pressure chamber having communication with said outlet port and enclosing the pivot portion of said ring for generating such an urging force as to urge said ring toward said pivot portion against the internal pressure, which is generated in said ring by a pumping action that, is weaker than said internal pressure; and a second pressure chamber disposed adjacent to the first-named pressure chamber through said seal pin and adapted to be supplied with the pump output pressure either directly or indirectly through a control valve for generating an urging force against the biasing force of said spring, the region extending between said circular bore of said housing and the outer circumference of said ring other than said pressure chambers being made to communicate with said inlet port.

According to this construction, the ring is controlled by at least two pressure chambers which are defined by means of the improved seal pins, wherein the first one effects hydraulic balance with the internal pressure acting upon the pivot portion thereby to drop that pressure to a remarkably low level. Thus, since the stress exerted upon the ring is remarkably reduced so that the weight of the ring can be reduced and since the force for urging the pivot portion is weak, the control stability of the ring pivotting motions can be markedly improved to enhance the output responsiveness so as to produce prompt responses to changes in the r.p.m. of the pump thereby providing a pump having a reduced input power loss and a high performance. Since no excessive pressure is applied to the pivot portion, moreover, this pivot portion can be so simplified as to employ a spherical member such as a ball in the pivot portion so that a better control stability of the ring pivotting motions can be attained.

Still moreover, since the suction and discharge can be performed in the radial directions as is different from the prior art in which they are performed from only one side, the axial length of the pump can be reduced to provide a two-side suction pump in which the suction is effected from both sides of the rotor.

In a further preferred embodiment, the aforementioned pump can use a ball, a ball having a spherical face, or a spherical roller in the pivot portion. As a result, not only the friction at the pivot portion can be reduced to smoothen the ring motions but also the pivot portion can be machined with ease and at a low cost.

According to a further preferred embodiment, said control valve includes: a spring fitted in a spring chamber communicating with said outlet port; a spool having its one end biased by said spring and its hollow portion formed on its outer circumference with at least two lands and in its inside with an orifice; a tank port having communication with said pump inlet port; a first port having communication with said pump outlet port and said hollow portion; and a second port adapted to communicate with the second-named pressure chamber and to be opened between said two lands and arranged at such a position as to communicate with said tank port, when the pressure difference between the upstream and downstream sides of said orifice is equal to or lower than a predetermined level, and with the first-named port when said pressure difference exceeds said predetermined level.

According to the construction thus far described, the throttle valve and its accompanying piping can be omitted so that the pump as a whole can be made compact and manufactured at a low cost. Since the control valve can be attached to or built into the pump without any difficulty, moreover, it is possible to provide a variable output vane pump which can have its parts interchanged with those of the product of the prior art.

DESCRIPTION OF THE PREFERRED EMBODIMENTS

Figure 1:
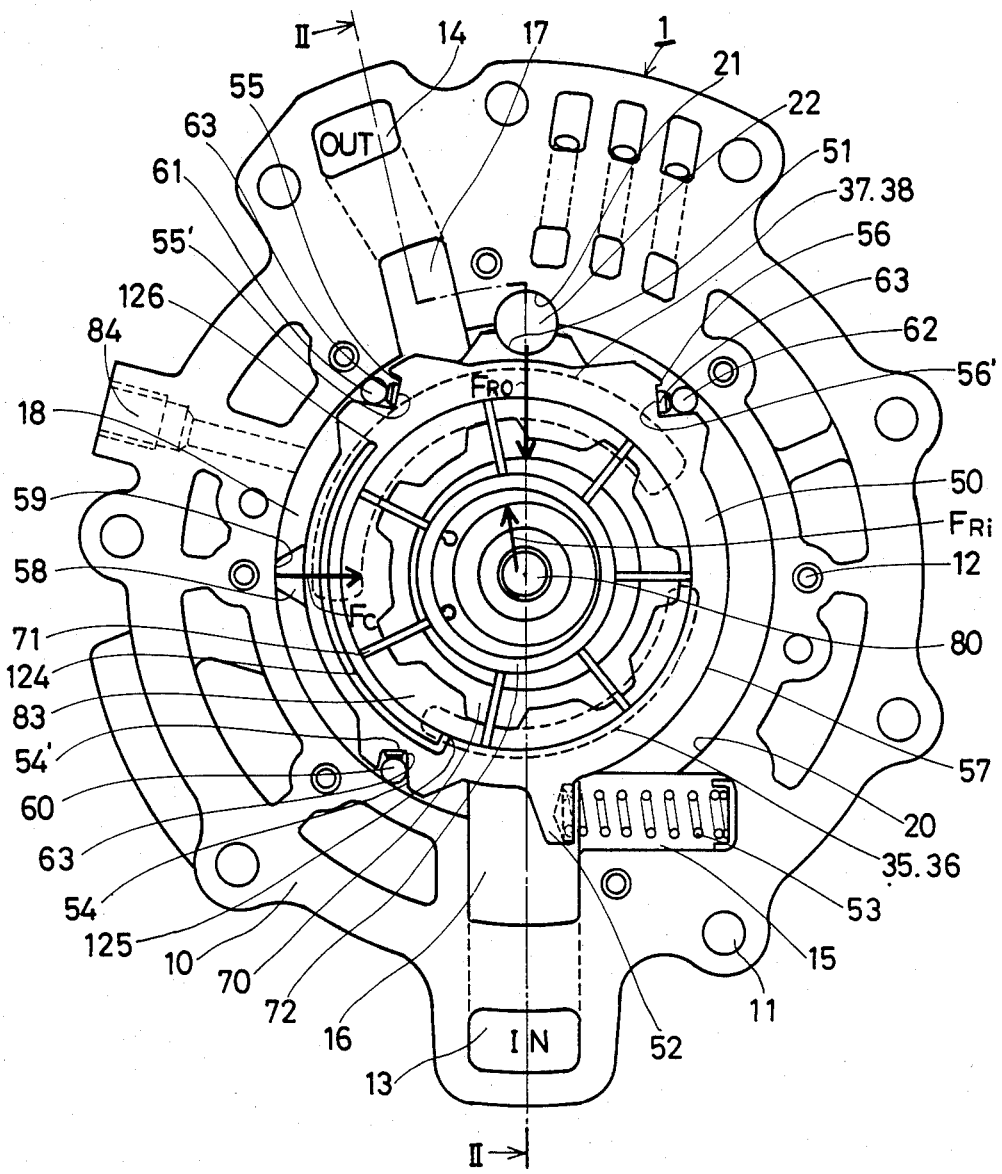
FIG. 1 is a section taken along line I—I of FIG. 2 and shows a pump according to an embodiment of the present invention.
Figure 2:
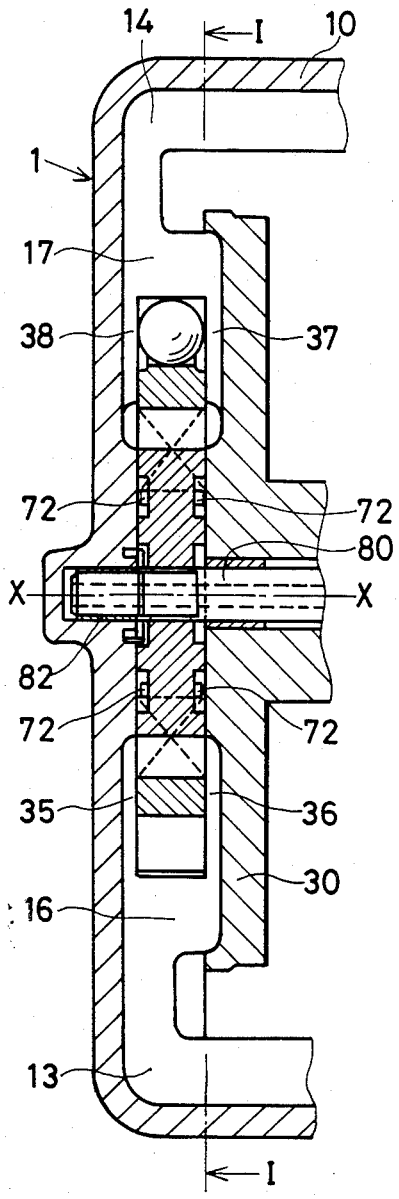
FIG. 2 is a section taken along line II—II of FIG. 1.

The present invention will be described in the following in connection with the embodiments thereof with reference to the accompanying drawings. FIG. 1 is a sectional view showing an embodiment of the present invention, and FIG. 2 is a section taken along line II—II of FIG. 1. Indicated generally at reference numeral 1 is a variable output vane pump which has a housing including a housing (A) 10, a housing (B) 30 and their accessories, unless specified. The variable vane pump 1 is mounted to a transmission body (not shown) through mounting holes 11 by means of bolts (not shown). The housing (A) 10 and the housing (B) 30 are joined by means of bolts (not shown) through tapped holes 12 which are formed in the housing (A) 10. The pump has its inlet port 13 communicating with an oil tank by way of a passage of the transmission body. On the other hand, the outlet port 14 of the pump is made to communicate with an actuator by way of another passage (not shown) of the transmission. The pump housing (A) 10 is formed therein with a generally circular bore 20 which extends in the axial direction. This bore 20 is formed in its upper portion with a semicircular groove 21 in which a pivot ball 22 is fitted. In the bore 20, there is fitted a ring 50 having its upper portion formed with a semicircular groove 51, in which the pivot ball 22 is fitted. As a result, the ring 50 is supported in the bore 20 such that it can be rotated in the bore in the radial direction while using the pivot ball 22 as its pivot. The openings of the ring 50 at both sides in the axial direction are blinded by the opposed inner walls of the housings (A) 10 and (B) 30 to define pump chambers 83 in cooperation with both a rotor 70 fitted in the ring 50 and vanes 71. The ball 22 is used as the pivot member in the embodiment under consideration but may be exemplified by a round roller having a round face or a pin having a shape similar to that of FIG. 8 in which case, such roller or pin may simultaneously be used as a sealing pin as disclosed in FIG. 1 of U.S. Pat. No. 4,342,545 to seal one end of a pressure chamber which will be described in detail hereinafter. The ring 50 is formed at its lower portion with a protrusion 52 which is urged to the left, as viewed in FIG. 1, by the action of a spring 53 fitted in a hole 15 of the pump housing so that the ring 50 is offset to the left with respect to the rotor 70. The housing bore 20 is arranged, as better seen from FIG. 2, with a suction chamber 16, which has communication with the pump inlet port 13, and a discharge chamber 17 which has communication with the pump outlet port 14. The suction chamber 16 and the discharge chamber 7 are arranged in the radial directions, i.e., in the directions perpendicular to the rotor shaft 80. Moreover, the suction chamber 16 has communication with arcuate inlet ports 35 and 36, which are disposed at both sides of the pump chambers 83, across the two sides of the ring 50, whereas the discharge chamber 17 also has communication with arcuate ports 37 and 38, which are disposed at both sides of the pump chamber 83, across the two sides of the ring 50. This ring 50 has its outer circumference formed with three protrusions 54', 55' and 56' which extend outward and which in turn are formed with axially extending grooves 54, 55 and 56. In these grooves, there are fitted both seal pins 60, 61 and 62, which are in respective sliding contacts with the bore 20, and three elastic members 63 each of which underlies the seal pins 60, 61 and 62. The space defined by the bore 20 of the pump housing and by the outer circumference 57 of the ring is divided into three sealed compartments by means of the three seal pins. Specifically: the compartment between the seal pins 60 and 62 defines the suction chamber 16; the compartment between the seal pins 61 and 62 defines the discharge chamber 17; and the compartment between the seal pins 60 and 61 defines a control chamber 18. The ring 50 is formed at its lefthand side with a protrusion 58 which has its leading end 59 providing a stopper, which is brought into contact with the pump housing bore 20, in case it is urged to the left by the action of the spring 53. In the ring 50, there are fitted the rotor 70, the vanes 71 which can move freely into and out of the rotor 70, a guide ring 72 which is made operative to urge the vanes 71 to contact with the inner circumference of the ring 50 even when the pump is stopped. The rotor 70 has its radially inside portion splined to the shaft 80 so that it is supported rotatably within the housing 10 and 30 by the action of the shaft 80. Reference numeral 82 indicates a bearing. The shaft 80 may be formed into the shape of a sleeve shaft, which extends usually from the engine transmission as well known in the art, although it is schematically shown in the drawing.

Figure 3:
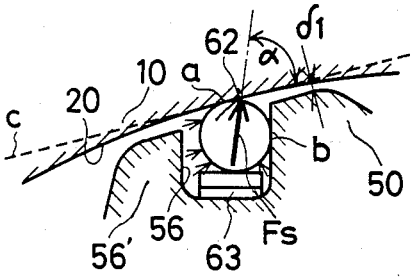
FIG. 3 is a partially enlarged view of FIG. 1.
Figure 4:
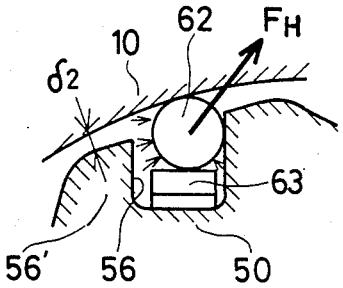
FIG. 4 is a view similar to FIG. 3 but explains the operation of the same.
Figure 5:
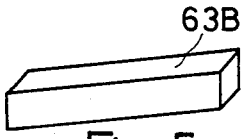
FIGS. 5 and 6 are enlarged perspective views of two different embodiments of the elastic member shown in FIG. 1.
Figure 6:
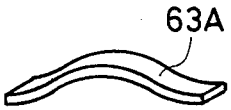

The sealing operations by the seal pins 60, 61 and 62 will be described with reference to FIGS. 3 to 8 (of which FIG. 3 is an enlarged view showing the portion around the protrusion 56' located at the righthand upper portion of FIG. 1). The seal pin 62 (as shown in FIG. 8) has an axial length substantially similar to that of the ring 50 and is urged at all times in the direction of arrow $F_S$ (as shown in FIG. 3) by the action of the elastic member 63 such as a leaf spring 63A (as shown in FIG. 6) or a synthetic rubber 63B (as shown in FIG. 5). The seal pin 62 is always in contact at and urged by the elastic member 63 toward two points a and b (as shown in FIG. 3) because the contact angle against the bore 20 of the housing 10 is acute. When the discharge pressure of the pump rises, this high pressure oil exerts its high pressure upon the side of the seal pin 62 to urge the seal pin in the direction $F_H$ of FIG. 4 showing the operating state thereby to ensure seals at the two points a and b. More particularly, as shown in FIG. 3, the tangential line C, on which the seal pin 62 contact with the housing bore 20, and the urging direction $F_S$ of the elastic member 63 have to be angularly positioned at an acute angle $\alpha$ smaller than 90 degrees. The ring 50 is formed at its two sides with grooves 124, each of which has its one end 125 communicating with the pump suction chambers 35 and 36 and its other end 126 blinded, thereby to prevent the pressure of the oil in the pump chambers 83 from leaking out into the second pressure chamber 18.

As shown in FIGS. 3 and 4, the gaps $\delta_1$ and $\delta_2$ between the outer circumference of the ring and the bore of the housing are varied slightly by the rocking motions of the ring around the pivot. It is necessary to ensure reliable seals even for those variations. Thanks to the construction thus far described, the seal pin never fails to contact with the outer circumference of the ring and the bore of the housing at those two points a and b by the action of the elastic member 63. The spring force of the elastic member in this instance may be such a remarkably low load as to merely raise the pin so that it can suppress the sliding resistance at the sealing points a and b at a low level while the ring is rocking. Under increased pressure, on the other hand, the hydraulic pressure is so exerted by the angle $\alpha$ as to ensure automatically the contacts at the points a and b thereby to ensure the sealing performance. Thus, the levels of "the order of the pump discharge pressure">"the control pressure">"the pump suction pressure" are maintained at all times so that the contact point b is never released.

As a result, in spite of the low sliding resistance of the seals, the sealing effects are ensured to provide a pump which has its sealing performance improved to provide a high performance having a high durability and a low input power loss.

The operations of the pump shown in FIG. 1 will be described in the following. The rotor 70, the vanes 71 and the guide ring 72 are rotated clockwise. The vanes are brought radially outward by the centrifugal force generated during the rotations and by the guide of the guide ring so that they slide while having their leading ends contacting with the ring bore at all times. As a result, the pump chambers 83 are supplied below the line X—X of FIG. 2 with the working oil by way of the inlet port 13 communicating with the tank, the suction chamber 16 and the arcuate intake ports 35 and 36 at both sides of the ring, thus effecting the sucking operations. The oil thus sucked is discharged above the line X—X to the outside by way of the arcuate discharge ports 37 and 38 at the two sides of the ring, the discharge chamber 17 and the outlet port 14.

In the state of FIG. 1, the central axis of the ring 50 is offset to the most eccentric position with respect to the center, i.e., the axis of rotation of the rotor 70 is urged by the urging force of the spring 53 so that the discharge or output of the pump is changed in proportion to the r.p.m. of the same. If, now, the control chamber 18 defined by the seal pins 60 and 61, the housing bore 20 and the ring outer circumference 57 are supplied from the outside with the control pressure by way of a port 84, there is established in the ring a force which will urge the ring to the right, as viewed in FIG. 1, against the urging force of the spring 53. However, the ring is always subjected to the urging force which is directed upward, as viewed in FIG. 1, namely, toward the pivot ball so that it is rocked counter-clockwise around the pivot ball. As a result, the eccentricities of the ring and the rotor are so reduced that the discharge of the pump is accordingly dropped, as is well known in the art. In other words, the theoretical discharge of the pump can be varied by varying the pressure of the control chamber.

The first pressure chamber 17, i.e., the discharge chamber encloses the pivot portion 22 and is subjected to the pump discharge pressure to generate an urging force FRO which is directed against the internal pressure FRT generated in the ring 50 by the pumping action but weaker than the same. Thanks to this construction, the force for the ring 50 to urge the pivot ball 22 is remarkably weakened by the pressure of the discharge chamber 17 so that the stress exerted upon the ring 50 can be dropped to a markedly low level. Moreover, the control stability of the pivotal motions of the ring is improved to an outstanding level thereby enhancing the discharge responsiveness. On the other hand, the pivot portion can be manufactured at a low cost without any high accuracy. Still moreover, the suction can be effected at both sides of the rotor 70 so that the pump can have its axial length reduced.

The elastic member 63 is exemplified by the synthetic rubber **63*b* shown in FIG. 5 and by the leaf spring 63A shown in FIG. 6. In order to ensure the actual function, however, the elastic member 63 is required to have a considerable deflection and a complete elastic restoration for the repeated stresses applied. However, the synthetic rubber 63B is deficient in the deflection and restoration characteristics whereas the leaf spring 63A is difficult to design and so weak in strength that it is liable to flex so that it cannot be used because of its deficient elastic restoration properties. Thus, both the synthetic rubber 63B and the leaf spring 63A** may sometimes be short of the functions required as the elastic member.

Figure 7:
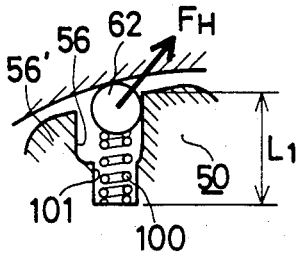
FIG. 7 is an explanatory view showing the operation of the elastic member.
Figure 8:
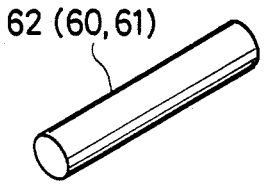
FIG. 8 is an enlarged perspective view showing one of the seal pins of FIG. 1.
Figure 9:
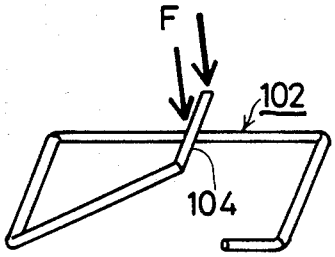
FIG. 9 is an enlarged perspective view showing another embodiment of the elastic member.
Figure 10:
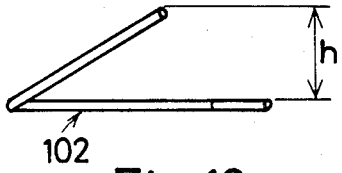
FIGS. 10 and 11 are a side elevation and a top plan view showing the formed wire spring of FIG. 9, respectively.
Figure 11:
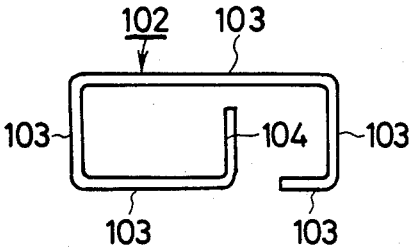

In order to satisfy the required function, as shown in FIG. 7, it is sufficient to use one or more coil springs 100, for example. In this instance, however, it is necessary that the groove 56 of the ring 50 be machined with a hole 101 in which the coil spring 100 is to be fitted. Then, not only the machining and assembly become difficult but also the height $L_1$ of the recess becomes partially increased so that the ring 50 has its thickness reduced thereby raising a problem of strength. This problem is accompanied by a problem that the size of the ring 50 has to be enlarged. This problem is solved by the improved formed wire springs which are shown in FIGS. 9–11 and in FIG. 16. The embodiment of FIG. 9 is directed to a formed wire spring 102 which has its respective outer sides 103 formed into a generally rectangular shape resembling generally the outer peripheries of the rectangular bottoms of the aforementioned grooves 54, 55 and 56 and which has its inner end portion 104 bent inward to have such a height h (as shown in FIG. 10), i.e., a free length as not to be folded. The formed wire spring 102 of FIG. 9 is made of a solid metal wire having a generally circular section but may be made hollow or may have a square section. Moreover, the formed wire spring 102 is formed into a generally angular G-shaped top plan view, as seen in FIG. 11.

Figure 16:
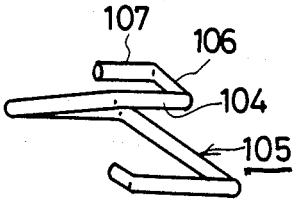
FIG. 16 is an enlarged perspective view showing another embodiment of the formed wire spring.

On the other hand, the formed wire spring 105 shown in FIG. 16 has its end portion 106 bent twice inward generally at a right angle to enlarge the free length and to urge the seal pin at two points in a stable manner.

Figure 12:
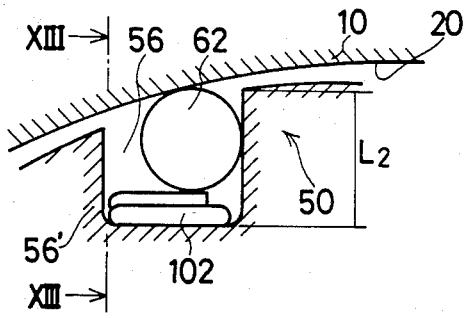
FIG. 12 is an enlarged partial section showing the state in which the formed wire spring of FIG. 9 is depressed when it is fitted in the pump shown in FIG. 1.
Figure 13:
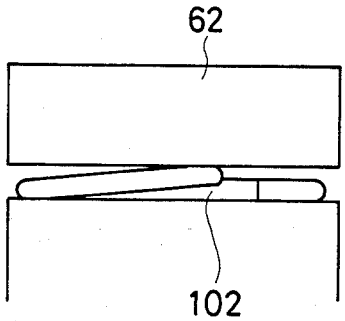
FIG. 13 is a schematic front elevation as viewed in the direction of XIII—XIII of FIG. 12.
Figure 14:
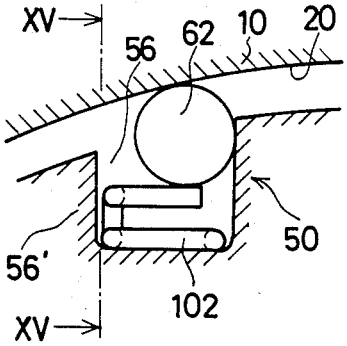
FIG. 14 is similar to FIG. 12 but shows the spring restored its length.
Figure 15:
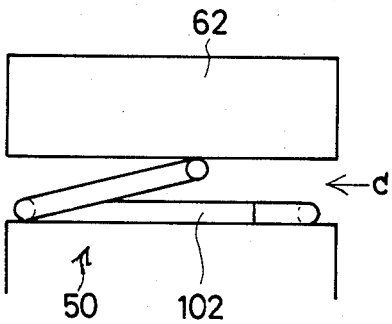
FIG. 15 is a schematic front elevation as viewed in the direction of XV—XV of FIG. 14.

Thanks to the construction thus far described, the formed wire springs 102 and 105 can have their contact heights reduced to the same level as the diameter thereof when they are depressed from the above as in the direction F of FIG. 9. Since the outer sides 103 are shaped to resemble the outer peripheries of the bottoms of the grooves 54, 55 and 56, moreover, the total length of the springs can be enlarged as much as possible so that the free length, i.e., the height h can be accordingly enlarged. As a result, as shown in FIGS. 12 to 15, the formed wire springs 102 and 105 can retain sufficient deflection and complete elastic restoration having high strength, even if they are fitted in grooves having limited space, so that they can depress properly the seal pin 62 to the housing bore 20 at all times, no matter how the ring 50 and the housing bore 20 might be displaced relative to each other, thus completing their sealing functions. On the other hand, the grooves can be made shallow as indicated at $L_2$ (as shown in FIG. 12) so that the ring can have its size reduced and its strength improved. On the other hand, the formed wire springs 102 and 105 may be driven in the direction C (as shown in FIG. 15) when they are assembled, after the seal pin 62 has been inserted, so that their assemblies can be remarkably simplified. Moreover, the springs are formed of wire so that they are easy to design and inexpensive to manufacture.

Figure 17:
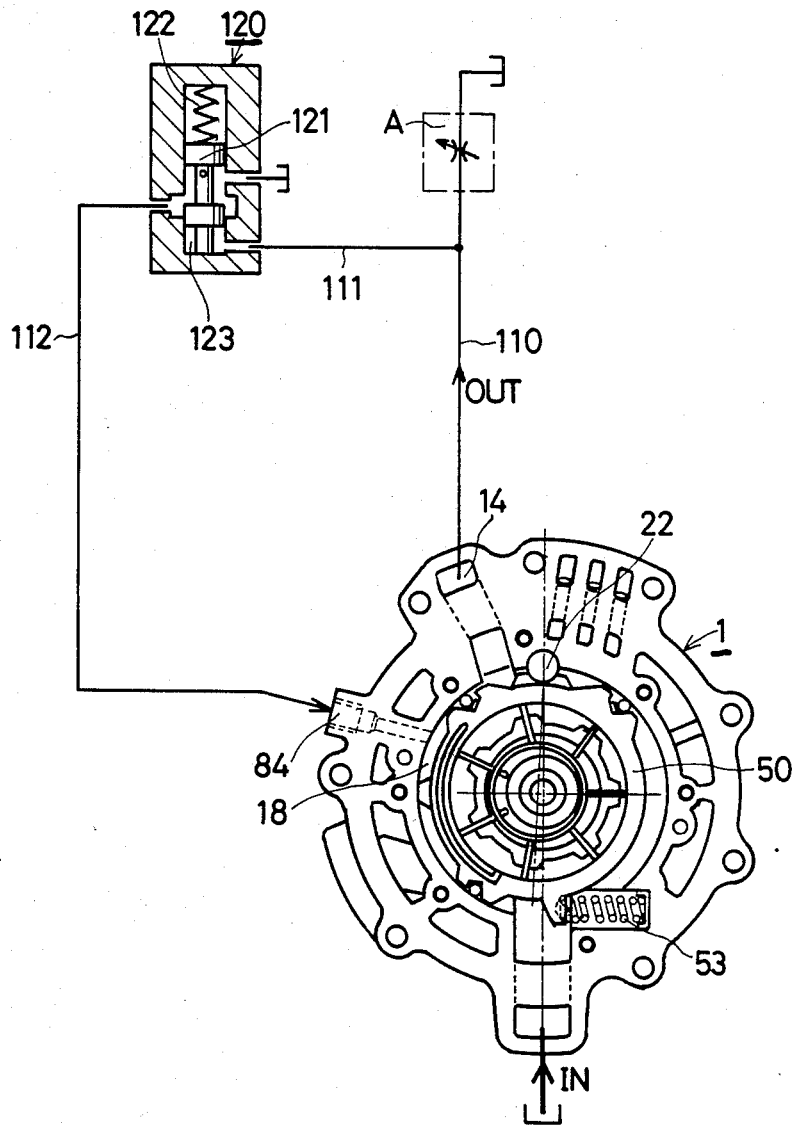
FIGS. 17, 18 and 19 are hydraulic circuit diagrams showing different embodiments of the control valve for controlling the output of the pump.

FIG. 17 shows an embodiment of the control valve for controlling the pump of the present invention. The parts corresponding to those of FIG. 1 are indicated by corresponding reference characters.

The outlet port 14 of the pump is connected with the actuator A of the automatic transmission by way of a discharge passage 110 so that the working oil is fed from the pump to the actuator A. From the discharge passage 110, on the other hand, there is branched a passage 111 which leads to a sequence valve 120. From the sequence valve 120, there leads a passage 112 which communicates with the control chamber 18 of the pump by way of the port 84. The sequence valve 120 is equipped with a spool 121 and a spring 122, the former being urged downward, as seen in FIG. 17, by the latter.

In accordance with the rise in the r.p.m. of the pump, the pressure of the valve chamber 123 of the sequence valve 120 is boosted so that the spool 121 is shifted upward in the drawing. In response to the shift of the spool 121, the communication between the passages 111 and 112 is established to introduce the pressure liquid into the control chamber 18 thereby increasing the pressure in the control chamber 18. Because of this pressure in the control chamber, the ring 50 is rocked counter-clockwise around the pivot ball 22 against the urging force of the spring 53 so that the discharge of the pump is reduced. When the output pressure of the pump is dropped, on the contrary, the spool 121 is shifted downward to block the communication between the passages 111 and 112 so that the discharge of the pump is accordingly increased. The operations thus far described are automatically conducted so that the maximum pressure in the circuit can be maintained at a constant level even if the r.p.m. of the pump is varied.

Figure 18:
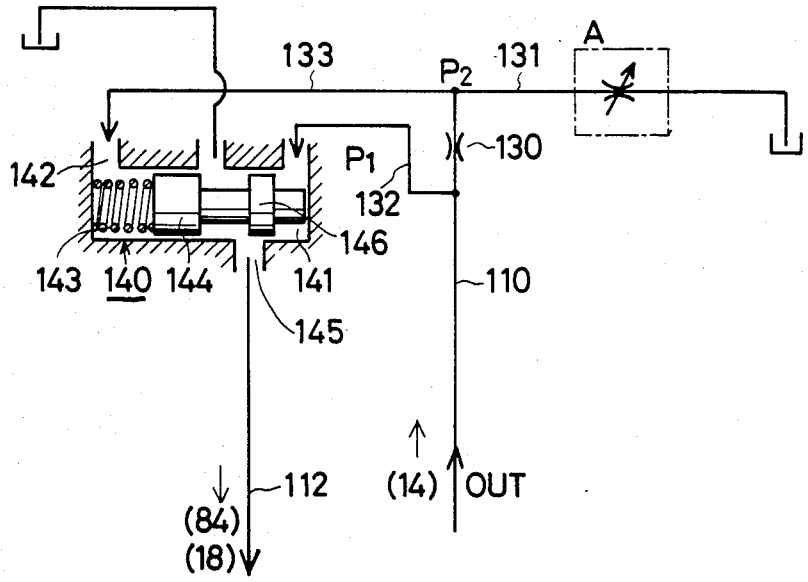

FIG. 18 shows another embodiment of the control valve. This embodiment contemplates to maintaining the discharge of the variable vane pump at a constant level for a pump r.p.m. higher than a predetermined value. The discharge passage 110 has communication with the outlet port 14 of the pump as in the embodiment of FIG. 17 and further with the actuator A by way of an orifice 130 and a passage 131. From the discharge passage 110, there is branched a branch passage 132 which is made to communicate with a valve chamber 141 formed at one end of the spool 144 of a constant pressure difference valve 140. From the passage 131, there is branched a branch passage 133 which has communication with a valve chamber 142 formed at the other end of the spool 144. In the valve chamber 142, there is fitted a spring 143 which urges the spool 144 to the right of the drawing. An outlet port 145 to be throttled by the land 146 of the spool 144 is made to communicate with the control chamber 18 of the pump by way of the port 84.

Thanks to the construction thus far described, if the diameter of the orifice 130 and the strength of the spring 143 of the constant pressure difference valve are selected at suitable levels, the spool 144 is urged to the right of the drawing by the action of the spring 143, while the oil is flowing through the orifice 130 at a flow rate not higher than a regulated value, to block the communication between the branch passage 132 and the passage 112 so that no oil flows into the control chamber 18. At this time, the pump has its discharge varying in proportion to the r.p.m. thereof. When the pump r.p.m. is increased so that the flow rate of the oil passing through the orifice 130 is accordingly increased, the pressure difference between the upstream and downstream of the orifice is augmented in proportion to the oil flow rate. Moreover, this pressure difference is exerted upon the two sides of the piston 144 by way of the passages 132 and 133. As a result, when the pressure difference exceeds a predetermined level, the spool is disposed to the left of the drawing against the action of the spring. This results in establishment of the communication between the passages 132 and 112 to feed the control chamber of the pump 18 with the pressure oil thereby to reduce the discharge of the pump. The pressure difference, at which the communication between the passages 132 and 141 is started, is subjected to the force of the spring 143. The spool 144 operates to maintain the pressure difference between the upstream and downstream ends of the orifice always at the value which is regulated by the spring 143.

If the pressure difference is increased, more specifically, the spool is displaced to the left of the drawing to provide communication between the passages 132 and 12 thereby to reduce the discharge of the pump. If the pressure difference decreases, on the contrary, the communication between the passages 132 and 112 is blocked to increase the discharge of the pump. Thanks to the operations conducted automatically, the pump discharge can be maintained at a constant level for the rpm's higher than the predetermined value.

Figure 21:
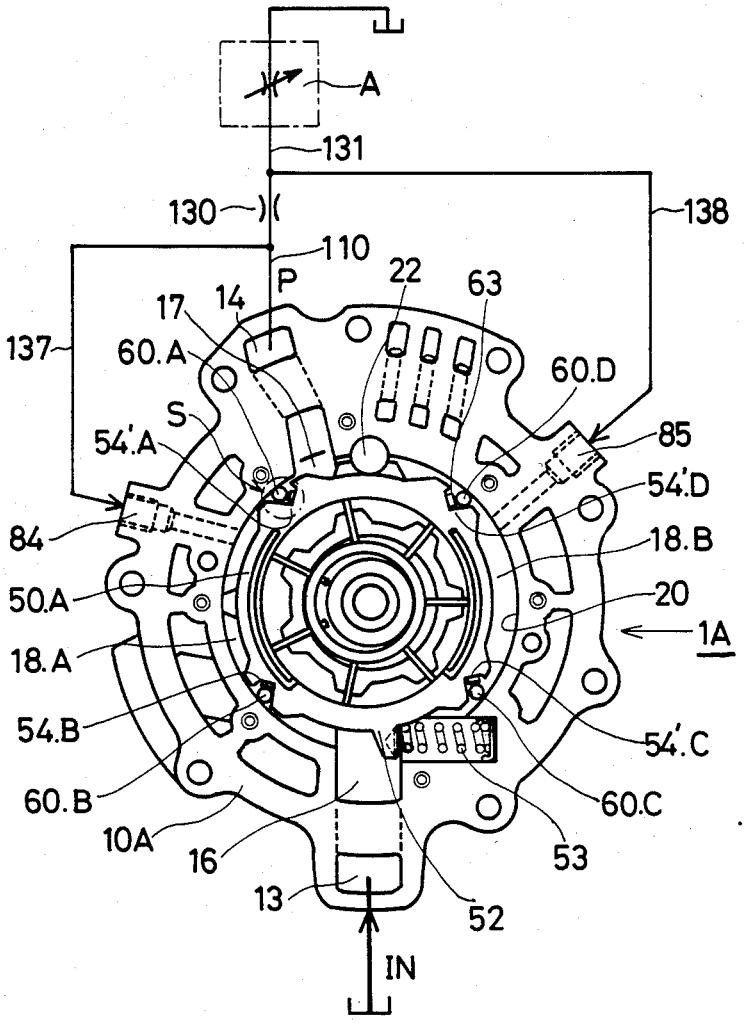
FIG. 21 is a sectional view similar to FIG. 1 but shows a further embodiment of the present invention different from that of FIG. 1 together with its control circuit.

FIG. 21 shows another embodiment in which the constant flow rate is maintained for the rpm's higher than the predetermined level. The parts corresponding to those of FIG. 1 are indicated at reference numerals to which capital letters A, B, C and D are attached. According to this embodiment, the pump outlet port 14 is made to communicate with the actuator A by way of the discharge passage 110, the orifice 130 and the passage 131. From the discharge passage 110, there is branched a branch passage 137 from which the discharge pressure is introduced through the control port 84 to the control chamber 18A defined by seal pins 60A and 60B. From the passage 131, there is branched a branch passage 138 from which the discharge pressure having passed through the orifice is introduced through the control port 85 to a control chamber 18B defined by seal pins 60C and 60D.

The oil thus discharged out of the pump is introduced through the orifice 130 to the actuator. When the oil just passes through the orifice 130, there is established between the upstream and downstream ends of the orifice 130 a pressure difference which corresponds to the flow rate of the oil passing through the orifice. Since oil at these respective pressure is introduced to the control chambers 18A and 18B, the ring 50A is going to rotate to the right of the drawing by the hydraulic pressure which is built up by that pressure difference. However, the ring 50A is equipped at its one end 52 with the spring 53 which in turn urges the ring 50A to the left of the drawing. As a result, while the hydraulic pressure is weaker than that spring force, the ring 50A is held in the state shown in FIG. 21 to discharge the oil in proportion to its r.p.m. If the r.p.m. is further increased so that the flow rate of the oil passing through the orifice is accordingly increased, however, the pressure difference between the upstream and downstream ends of the orifice is proportionally raised. As a result, the hydraulic pressure acting upon the ring is strengthened. If this hydraulic force overcomes the spring force, the ring 50A is rotated to the right of the drawing to have its eccentricity reduced to drop its discharge. In these ways, the pump flow rate is automatically controlled to a constant value by the hydraulic force of the control chamber and by the force of the spring so that the pressure difference between the upstream and downstream ends of the orifice may become constant for the rpm's higher than the predetermined level. Here, the optimum control can be selected by varying the orifice diameter, the seal section (or the control chamber range) by the seal pins and the spring force.

Figure 19:
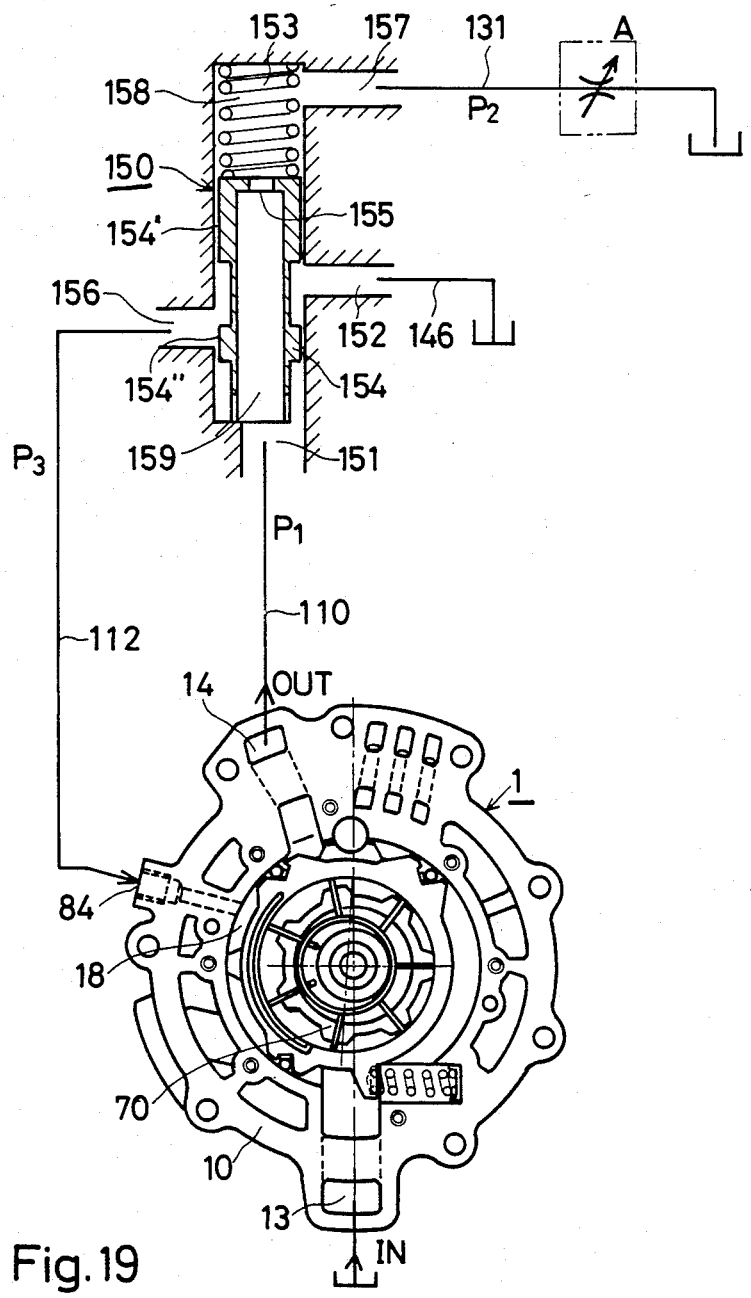

The pump control by a control valve 150, which has its orifice 130 of FIG. 18 built into the constant pressure difference valve 140, is shown in FIG. 19. The control valve 150 is constructed to include: a spring 153, which is mounted in a spring chamber 158 having communication with an outlet port 157 connected with the actuator A; a spool 154 which is formed on its outer circumference with at least two lands 154′ and 154″ and therein with a hollow portion 159 having an orifice 155 and which has its one end urged by the action of the spring 153; a tank port 152 communicating with the pump inlet port; a first port 151 communicating with the pump outlet port 14 and the hollow portion 159 by way of the passage 110; and a second port 156 which is made to communicate with the control chamber 18 through the port 84 by way of the passage 112, which is opened between the two lands 154′ and 154″ and which is so arranged to communicate with the tank port 152, when the pressure difference between the orifice 155 is not higher than a predetermined level, and with the first port 151 when the same pressure difference exceeds the predetermined level. The orifice 155 need not be positioned adjacent to the spring 153, as in the embodiment shown in FIG. 19, but may be formed either inside of the spool 154 or adjacent to the first port 151 at the opposite side.

Thanks to the construction thus far described, if the diameter of the orifice 155 and the strength of the spring 153 of the constant pressure difference valve are selected at suitable values, the spool 154 is urged downward of the drawing by the action of the spring 153, while the oil is flowing through the orifice 155 at a flow rate not higher than a regulated value, to block the communication between the passage 112 and the discharge passage 110 so that no oil flows through the control chamber 18. At this time, the pump has its discharge varied in proportion to its r.p.m. If this r.p.m. is augmented to increase the flow rate of the oil passing through the orifice 155, the pressure difference between the upstream and downstream ends of the orifice is augmented in proportion to the oil flow rate. On the other hand, this pressure difference is exerted directly upon the upper and lower sides of the spool 154. If this pressure difference exceeds the predetermined level, the spool 154 is displaced upward of the drawing against the force of the spring 153. This results in establishment of the communication between the passages 110 and 112 to feed the pressure oil to the control chamber 18 so that the discharge of the pump is decreased. The pressure difference, at which the communication between the passages 110 and 112 is started, is governed by the force of the spring 153. The spool 154 operates to maintain the pressure difference between the upstream and downstream ends of the orifice always at such a level as is regulated by the spring 153.

If the pressure difference is increased, more specifically, the spool 154 is displaced upward of the drawing to provide communication between the passages 110 and 112 thereby decreasing the discharge of the pump. If the pressure difference is dropped, on the other hand, the communication between the passages 110 and 112 is blocked to resultantly augment the pump discharge. Thanks to the operations conducted automatically, the discharge of the pump can be maintained at a constant level for its r.p.m. not lower than the predetermined value.

As has been described hereinbefore, as different from FIG. 18, the present example can have its valve number and its piping reduced to less than one half to simplify the piping so that the system as a whole can be made compact and manufactured at a low cost.

Figure 20:
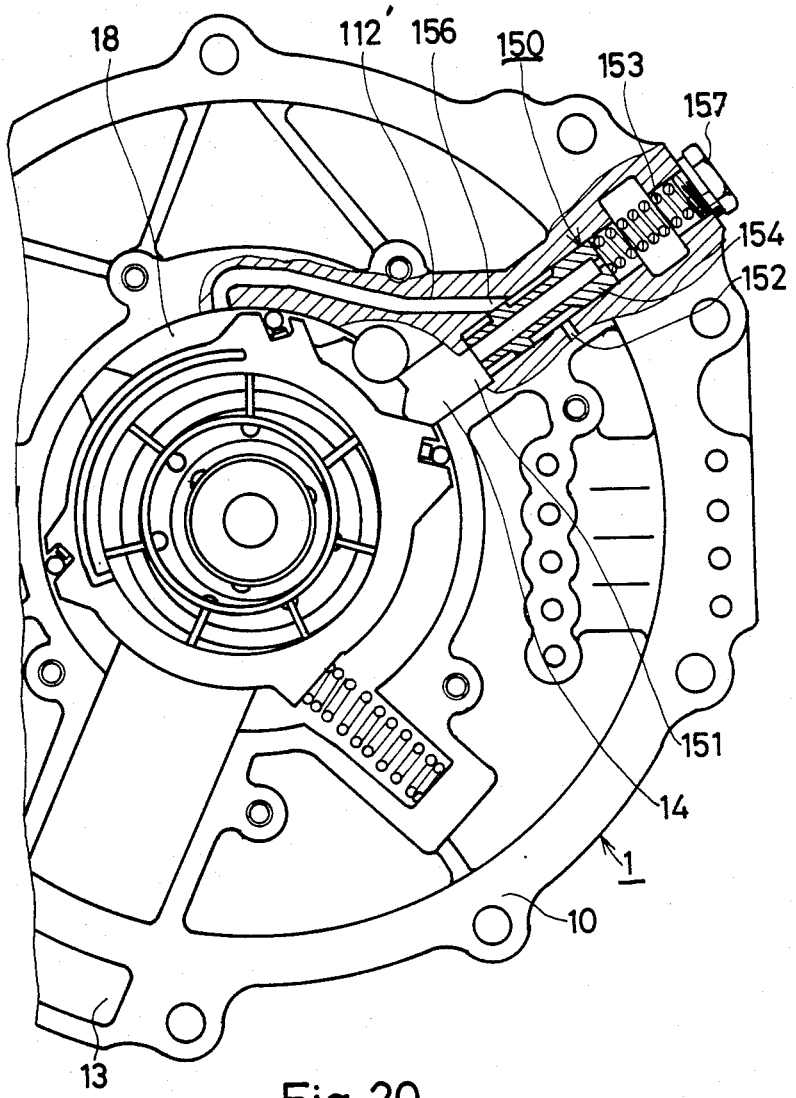
FIG. 20 is a partially sectional view similar to FIG. 1 but shows another embodiment in which the control valve of FIG. 19 is mounted in the pump housing.

Moreover, the control valve 150 can be mounted in or formed integrally with the housing 10 of the pump 1 because it can have its size reduced. With reference to FIG. 20, more specifically, the control valve 150 shown in FIG. 19 is made integral with the outlet port 14 of the housing 10, and the respective ports 152, 151, 156 and 157 of the control valve 150 are made to communicate, respectively, with the pump inlet port 13 through a housing hole (not shown), with the pump outlet port 14 in a direct manner through the port, and with the pump control chamber 18 through the hole 112′ formed in the housing by way of the passages which are formed in the housing. It will be apparent to those skilled in the art that effects similar to those of FIG. 19 can be attained by attaching the control valve 150 to the pump 1 in such a way that the control valve 150 is formed as a cartridge valve which is screwed in the hole formed in the outlet port 14.

Thanks to the construction thus far described, the system can be made so remarkably compact as to solve the problem that the system has been difficult to use because the automatic transmission to be mounted in the limited engine room requires two or more control valves in accordance with the prior art. Moreover, the hydraulic system has to be markedly modified so as to use the variable pump in the hydraulic system of the automatic transmission using the constant output pump of the prior art. Such modification raises considerable difficulty in practice. According to the present invention, it is possible to provide an automatic transmission using the variable output vane pump merely by replacing only the pump without any outstanding change in the hydraulic system. This means that no other changes are required in the hydraulic system of the prior art.

What is claimed is:

1. In a variable output vane pump including a pump housing having a circular bore; a rotor supported rotatably within said housing; a plurality of vanes fitted in the outer circumference of said rotor, said vanes being displaceable radially into and out of said rotor; a ring supported by a pivot portion, said pivot portion connecting the circular bore of said housing to the outer circumference of said ring and enclosing said rotor and said vanes; and inlet and outlet ports formed in said housing, at least one pressure chamber for pivoting said ring being formed between the circular bore of said housing and the outer circumference of said ring by means of at least one seal pin fitted in an axial groove formed in the outer circumference of said ring and opening into the circular bore of said housing, said ring being urged by the action of a spring fitted in said housing in a direction opposite to that of the pressure built up by said pressure chamber, said direction being such that the axis of said ring is displaced from the axis of rotation of said rotor;

the improvement comprising an elastic member fitted in the bottom of said axial groove formed in the outer circumference of said ring and opening into the circular bore of said housing, said elastic member urging said seal pin both toward the circular bore of said housing and at the same time toward one of the side walls of said axial groove, the urging direction of said elastic member and a tangential line, on which said seal pin is tangential to the circular bore of said housing, being at an acute angle with respect to each other.

2. A variable output vane pump according to claim 1, wherein said elastic member comprises a formed wire spring contoured to conform to the outer periphery of the bottom of said groove, which has its inner end portion bent inward to have such a height as not to be folded.

3. A variable output vane pump according to claim 2, wherein said formed wire spring is in the shape of an angular letter "G".

4. A variable output vane pump according to claim 3, wherein said G-shaped, formed wire spring has its inner end portion bent twice inward substantially at a right angle.

5. A variable output vane pump according to claim 1, whrein said pivot portion includes a ball having a spherical surface, a groove formed in the circular bore of said housing and in the outer circumference of said ring having a shape complementary to that of said pivot portion thereby allowing sliding contact with said ball.

6. A variable output vane pump according to claim 1, wherein said first portion includes a cylindrical roller, a groove formed in the circular bore of said housing and in the outer circumference of said ring having a shape complementary to that of said first portion thereby allowing sliding contact with said cylindrical roller.

7. A variable output vane pump comprising a pump housing having a circular bore;

a rotor supported rotatably within said housing;

a plurality of vanes fitted in the outer circumference of said rotor, said vanes being displaceable radially into and out of said rotor;

a ring having first and second sides supported pivotally by a pivot portion, said pivot portion connecting the circular bore of said housing to the outer circumference of said ring and enclosing said rotor and said vanes;

inlet and outlet ports formed in said housing, first and second pressure chambers for pivotting said ring being formed between the circular bore of said housing and the outer circumference of said ring by means of a plurality of seal pins fitted in a plurality of axial grooves formed in the outer circumference of said ring and opening into the circular bore of said housing, said ring being urged by the action of a spring fitted in said housing in a direction opposite to that of the pressure built up by said pressure chambers, said direction being such that the axis of said ring is displaced from the axis of rotation of said rotor; and an elastic member fitted in the bottom of each of said plurality of axial grooves, each of said elastic members urging the seal pin fitted in the same groove both toward the circular bore of said housing and at the same time toward one of the side walls of said axial groove, the urging direction of said elastic member and a tangential line, on which said seal pin is tangential to the circular bore of said housing, being at an acute angle with respect to each other;

wherein said first pressure chamber communicates with said outlet port and encloses the pivot portion of said ring for generating a force urging said ring toward said pivot portion against the internal pressure generated in said ring by a pumping action which is weaker than said internal pressure, and said second pressure chamber is disposed adjacent said first pressure chamber, spaced therefrom by said seal pins and adapted to be supplied with the pump output pressure for generating an urging force against the biasing force of said spring, the region extending between the circular bore of said housing and the outer circumference of said ring other than said pressure chambers communicating with said inlet port.

8. A variable output vane pump according to claim 7, wherein said outlet and inlet ports are respectively formed in a radial direction within said housing and outside of said ring, said ports being adapted to communicate with said pressure chambers across the first and second sides of said ring.

9. A variable output vane pump according to claim 7, wherein the pump output pressure is introduced into said second pressure chamber through a control valve, and wherein said control valve is a sequence valve for introducing the pump output oil into said second pressure chamber when the pump output pressure exceeds a predetermined value.

10. A variable output vane pump according to claim 7, wherein said control valve includes a spring fitted in a spring chamber communicating with said outlet port;

a spool having one end biased by said spring and at least two lands formed on its outer circumference, said spool further having a hollow portion formed on its inside together with an orifice;

a tank port communicating with said pump inlet port;

a first port communicating with said pump outlet port and said hollow portion; and a second port adapted to communicate with said second pressure chamber and opening between said two lands, said second port being arranged at such a position as to communicate with said tank port when the pressure difference between the upstream and downstream ends of said orifice is not greater than a predetermined level and with said first port when said pressure difference exceeds said predetermined level.

11. A variable output vane pump according to claim 10, wherein said control valve is integral with and located within said housing.

12. A variable output vane pump according to claim 11, wherein said control valve housing and has its respective ports communicating with the inlet port, the outlet port and said second pressure chamber by way of oil passages formed in said housing.

13. A variable output vane pump according to claim 7, wherein said pump further includes a third pressure chamber disposed adjacent said first pressure chamber separated by one of said seal pins, wherein said third pressure chamber is arranged generally in symmetry with respect to the line joining the center of said pivot portion and the central axis of said ring, said third pressure chamber communicating with the downstream end of a throttle disposed downstream of said outlet port, and wherein said second pressure chamber is supplied directly with the pump output force from the upstream end of said throttle.

* * * * *

UNITED STATES PATENT AND TRADEMARK OFFICE

CERTIFICATE OF CORRECTION

PATENT NO. : 4,531,893

DATED : July 30th, 1985

INVENTOR(S) : Tomio Okoh et al

It is certified that error appears in the above—identified patent and that said Letters Patent is hereby corrected as shown below:

In the heading of the patent, under "[73] Assignee", after the first joint assignee data, please add the following second joint assignee data -- MAZDA MOTOR CORPORATION, Hiroshima-ken, Japan --.

Signed and Sealed this

*Fourteenth* Day of *January 1986*

[SEAL]

*Attest:*

DONALD J. QUIGG

*Attesting Officer*

*Commissioner of Patents and Trademarks*